US006698926B2

(12) United States Patent
Buchman

(10) Patent No.: US 6,698,926 B2
(45) Date of Patent: Mar. 2, 2004

(54) PROFILE CLEANING SLIDER

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 10/094,558

(22) Filed: Mar. 9, 2002

(65) Prior Publication Data

US 2003/0169949 A1 Sep. 11, 2003

(51) Int. Cl.[7] ..... B65D 33/16
(52) U.S. Cl. ..... 383/64; 24/400
(58) Field of Search ..... 383/64; 24/400, 24/427, 399

(56) References Cited

U.S. PATENT DOCUMENTS

| | | | | |
|---|---|---|---|---|
| 2,652,611 A | | 9/1953 | Jaster | |
| 2,736,079 A | | 2/1956 | Staller et al. | |
| 3,074,137 A | | 1/1963 | Hawley | |
| 3,426,396 A | * | 2/1969 | Laguerre | 24/427 |
| 3,579,747 A | | 5/1971 | Hawley | |
| 4,262,395 A | | 4/1981 | Kosky | |
| 5,020,194 A | * | 6/1991 | Herrington et al. | 24/400 |
| 5,301,395 A | | 4/1994 | Richardson et al. | |
| 5,442,837 A | * | 8/1995 | Morgan | 24/400 |
| 5,871,281 A | * | 2/1999 | Stolmeier et al. | 383/64 |
| 5,983,466 A | * | 11/1999 | Petkovsek | 24/400 |
| 6,299,353 B1 | | 10/2001 | Piechocki et al. | |

FOREIGN PATENT DOCUMENTS

| | | |
|---|---|---|
| FR | 2636923 | 9/1989 |
| GB | 2258010 | 1/1993 |

* cited by examiner

*Primary Examiner*—Jes F. Pascua
(74) *Attorney, Agent, or Firm*—Tracey D. Beiriger

(57) ABSTRACT

A reclosable closure arrangement for use with packages, such as food and non-food packages, that includes a zipper closure having a slider device to open and close a pair of mating closure profiles. The slider device includes a protruding cleaning plow that is received within the pair of closure profiles prior to the closing profiles being brought into mating engagement. The cleaning plow removes debris from each of the closure profiles to allow for more reliable sealing of the zipper closure.

8 Claims, 5 Drawing Sheets

PROFILE CLEANING SLIDER

FIELD OF THE INVENTION

The present invention is generally related to a closure arrangement for polymer packages, such as plastic bags. More particularly, the present invention relates to a slider device for use along a zipper-type closure for a resealable package.

BACKGROUND OF THE INVENTION

Many packaging applications use resealable containers to store various types of articles and materials. These packages may be used to store and ship food products, non-food consumer goods, medical supplies, waste materials, and many other articles. Resealable packages are convenient in that they can be closed and resealed after the initial opening to preserve the enclosed contents. The need to locate a storage container for the unused portion of the product in the package is thus avoided. As such, providing products in a resealable package appreciably enhances the marketability of these products.

Some types of resealable packages are opened and closed using a slider device. The slider device typically includes a separator or plow-type structure at one end that opens a zipper closure mechanism, having profiled elements or closure profiles, when the slider device travels in a first direction along the zipper closure. The sidewalls of the slider device are inwardly tapered from one end to the opposite end so that the sidewalls engage the closure profiles and progressively move them into engagement to close the resealable package when the slider device is moved along the zipper closure in a direction opposite to the first direction.

Some perishable goods contained within the resealable package, such as shredded cheese, are small in size or granular in nature and can become entrapped within the closure profiles after the package has been opened and a portion of the product removed. If the product becomes lodged in the profile elements, the product can reduce the performance of the resealable zipper closure by blocking the insertion of the male profile element into the female profile element. When this type of situation occurs, the user is required to physically remove the entrapped particles prior to again attempting to close the zipper by engaging the first and second closure profiles. Such step clearly reduces the effectiveness of the slider device.

Therefore, it is an object of the present invention to provide an improved slider device that includes a mechanism for removing product from within the closure profiles prior to the closure profiles being moved into engagement with each other.

SUMMARY OF THE INVENTION

The present invention is directed to a slider device for use along a zipper closure that closes the mouth of a flexible, reclosable package. The slider device includes means for dislodging particles from within the zipper closure as the slider device is moved to close the product package.

In accordance with the invention, the zipper closure includes a first closure profile and a second closure profile that engage each other to seal the zipper closure along the mouth of the product package. The first closure profile includes an open channel extending along its length and defined by a first closure post and a first guide post. The open channel receives a second closure post formed on the opposite, second closure profile. The second closure profile also includes a second open channel extending along its length and defined by a second guide post and a second closure post. The second open channel is configured to receive the first closure post when the first and second closure profiles are brought into engagement.

During normal use of the zipper closure, fine particles of a product can become entrapped within either the first or second open channels on the first and second closure profiles. The entrapped particles prevent proper engagement of the first and second closure profiles.

The slider device is configured to interlock the first closure profile with the second closure profile when the slider device is moved in a first direction. The slider device is further configured to disengage the first closure profile from the second closure profile when the slider device is moved in a second, opposite direction.

The slider device of the present invention includes a cleaning plow that extends from a first end of the slider device. The cleaning plow extending from the first end of the slider device is configured to be received within both the first open channel formed on the first closure profile and the second open channel formed on the second closure profile. The cleaning plow is received in the open channels of the closure profiles when the slider device is moved in the first direction to interlock the closure profiles.

Specifically, the cleaning plow includes a main body joined to the slider device. The main body includes a first cleaning projection that is received within the first open channel and a second cleaning projection that is received in the second open channel of the second closure profile. The first and second cleaning projections extend in opposite directions for the main body and are configured to be received in the first and second open channels.

In accordance with the invention, as the slider device is moved along the length of the zipper closure in the first direction to interlock the first closure profile with the second closure profile, the cleaning plow is pushed along the length of the first and second open channels defined by the first and second closure profiles. As the slider device continues to move along the length of the closure profiles, particles entrapped within the open channels are pushed in front of the cleaning plow. Thus, the cleaning plow operates to remove product particles from within the zipper closure prior to engagement of the first closure profile with the second closure profile.

The first closure profile and the second closure profile each include a cleaner relief formed near a first end of the product package. At least a portion of the first cleaner relief formed in the first closure profile extents into the first open channel of the first closure profile, while at least a portion of the second cleaner relief formed in the second closure profile extends into the second open channel formed in the second closure profile. As the slider device moves to its fully closed position, the cleaning plow pushes debris from each of the open channels out of the respective cleaner relief.

When the zipper is completely closed and the slider device is in its fully closed position, the first and second cleaning projections of the cleaning plow extend through the cleaner reliefs and help retain the slider device in its home, fully closed position.

DETAILED DESCRIPTION OF PREFERRED EMBODIMENTS

Flexible packages having zipper closures are common in today's packaging market. Typically, the zipper closure has a first and a second interlocking closure profile. The zipper closure provides easy opening and closing of the package mouth to gain access to the contents within the package interior.

The addition of a slider device to a flexible package, such as a plastic bag, is advantageous to aging or arthritic persons not having the physical ability to use just a zipper closure to reseal a bag. Additionally, the use of a slider device with a flexible package facilitates the use of the bag by users of all ages and abilities.

Figure 1:
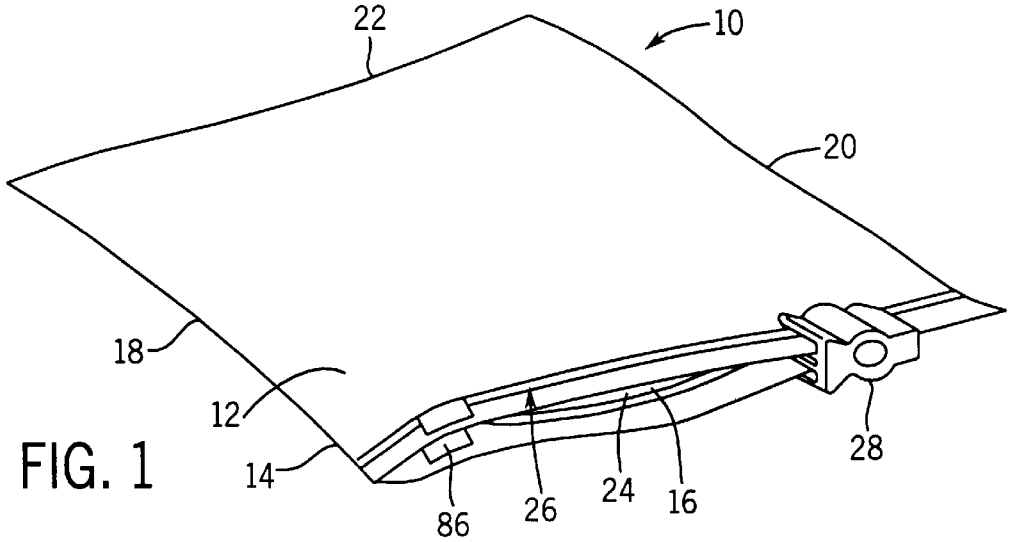
FIG. 1 is a perspective view of a flexible, reclosable package having a zipper closure and a slider device.

FIG. 1 illustrates a flexible, reclosable package 10. The flexible package 10 has a first and a second polymeric film side panels 12 and 14 defining an open interior 16. The flexible package 10 includes a pair of side edges 18 and 20 and a bottom edge 22. The pair of side panels 12 and 14 are connected to each other along the side edges 18 and 20 as well as the bottom edge 22 to form the open interior 16 of the package 10. The first side edge 18 and the second side edge 20 are seals created by the application of heat and pressure for a set period to the side panels 12 and 14.

As shown in FIG. 1, a mouth 24 provides access to the interior 16 of the package 10 along the top of the package. A zipper closure 26 is formed along the mouth 24 and extends from the first side edge 18 to the second side edge 20. The zipper closure 26 can include a variety of configurations and structures.

A slider device 28 is mounted on the zipper closure 26 to facilitate opening and closing of the zipper closure 26. The slider device 28 and its function to open and close the zipper closure 26, in general, are taught in U.S. Pat. Nos. 5,063,644; 5,301,394; 5,442,837 and 5,664,329, each of which are incorporated herein by reference.

Figure 2:
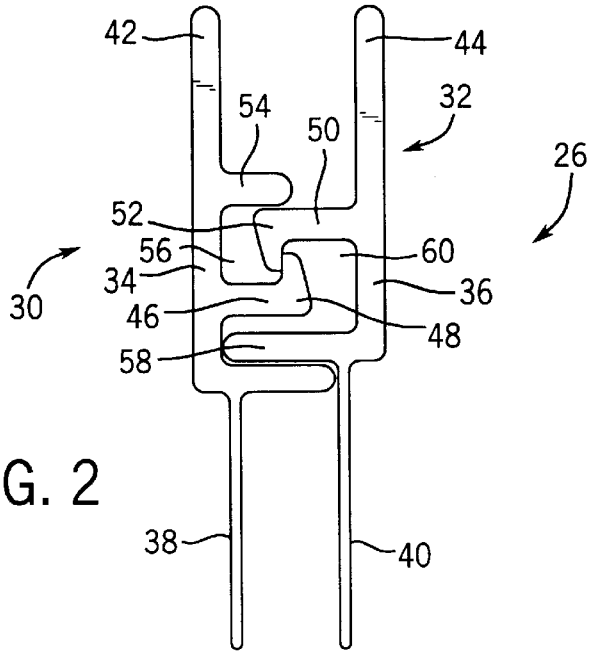
FIG. 2 is a cross-sectional view of the zipper closure, without the slider device disposed thereon.

Referring now to FIG. 2, thereshown is the zipper closure 26 utilized in the present invention. Although a specific embodiment of the zipper closure 26 is shown in FIG. 2, it should be understood that various other configurations for the zipper closure 26 could be used while falling within the scope of the present invention. The zipper closure 26 has a first closure profile 30 and a second closure profile 32. Specifically, the first closure profile 30 has a first interlocking profile 34 and the second closure profile 32 has a second interlocking profile 36. The first and second interlocking profiles 34 and 36 are arranged and constructed to interlock and provide a seal across the mouth of the package.

First and second closure profiles 30 and 32 include first and second sealing flanges 38 and 40 that are used to secure the closure profiles 30 and 32 to the respective side panels of the reclosable package. The first closure profile 30 includes a first upper flange 42 while the second closure profile 32 includes a second upper flange 44.

As illustrated in FIG. 2, the first closure profile 30 includes a first closure post 46 that terminates with a hook portion 48. The first closure post 46 receives and engages a second closure post 50 formed on the second closure profile 32. The second closure post 50 also includes a hook portion 52 such that mating engagement between the pair of closure profiles 30 and 32 can be effectuated.

As illustrated in FIG. 2, the first closure post 46 and a first guide post 54 combine to form an open channel 56 therebetween. The open channel 56 extends along the entire length of the first closure profile 30 and is sized to receive the hook portion 52 of the second closure post 50, as illustrated. Likewise, the second closure post 50 and a second guide post 58 of the second closure profile 32 create and define a second open channel 60 extending along the entire length of the second closure profile 32. The second open channel 60 is sized to receive the hook portion 48 of the first closure post 46. In this manner, the first closure profile 30 and the second closure profile 32 can be joined to each other to form the desired seal along the mouth of the flexible package.

Figure 3:
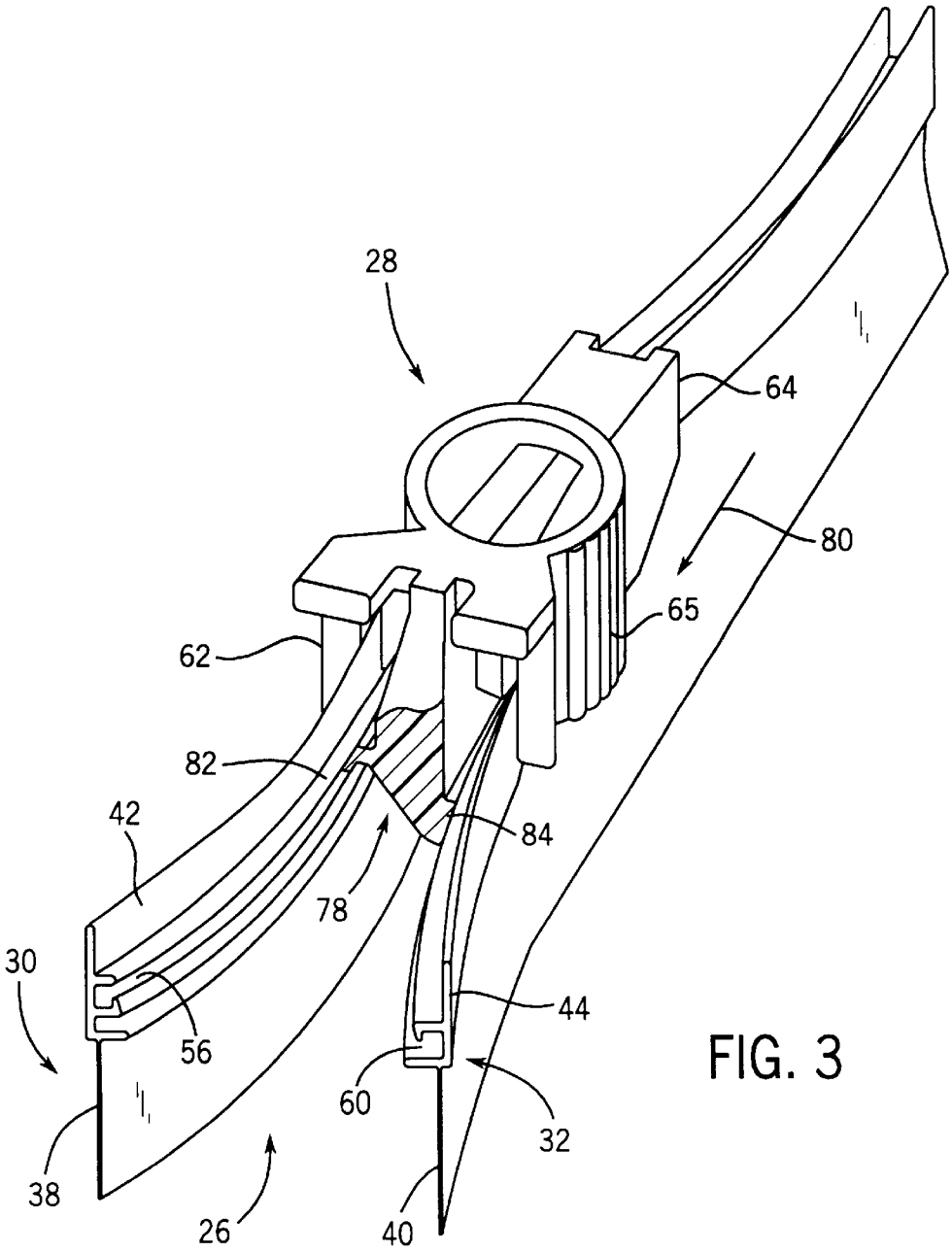
FIG. 3 is a perspective view illustrating the interaction between the cleaning plow of the slider device and the zipper closure to remove debris from the zipper closure.
Figure 8:
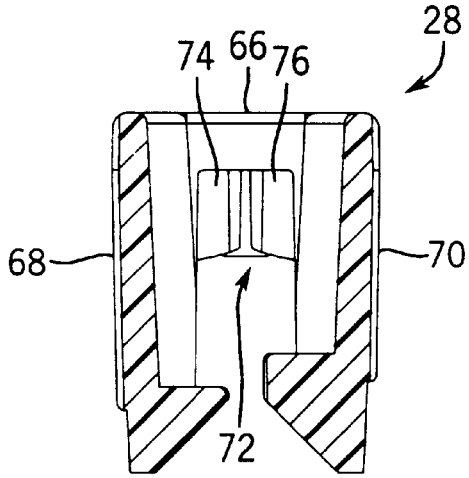
FIG. 8 is a section view of the slider device.

Referring now to FIG. 3, thereshown is a perspective view of the slider device 28 of the present invention as mounted to the first and second closure profiles 30 and 32. The slider device 28 generally extends between a first end 62 and a second end 64 and includes a grasping portion 65. As can be seen in FIG. 8, the slider device includes a top wall 66 and a pair of sidewalls 68 and 70 extending from the top wall 66. The slider device 28 includes a spreader or plow 72 extending or projecting from the upper wall 66. In the embodiment illustrated, the spreader 72 comprises first and second angled wedges 74 and 76 separated by a gap.

During use of the slider device 28, the spreader 72 positioned near the first end of the slide device 28 is used to guide the first and second closure profiles 30, 32 toward each other when the slider device 28 is moved in a first direction and separate the first and second closure profile 30, 32 when the slider device 28 is moved in a second, opposite direction.

Referring back to FIG. 3, the slider device 28 of the present invention includes a cleaning plow 78 that extends from the first end 62 of the slider device 28. The cleaning plow 78 is configured such that the cleaning plow 78 removes debris from the first open channel 56 of the first closure profile 30 and the second open channel 60 of the second closure profile 32 when the slider device 28 is moved in the first direction illustrated by arrow 80 in FIG. 3. The cleaning plow 78 thus allows the slider device 26 to clean out the open channels 56, 60 prior to the first closure profile 30 engaging the second closure profile 32. In this manner, the cleaning plow 78 provides for a more consistent closing of the zipper closure 26, especially when the package includes small particles of material that could be entrapped in the open channels 56 and 60.

Figure 4:
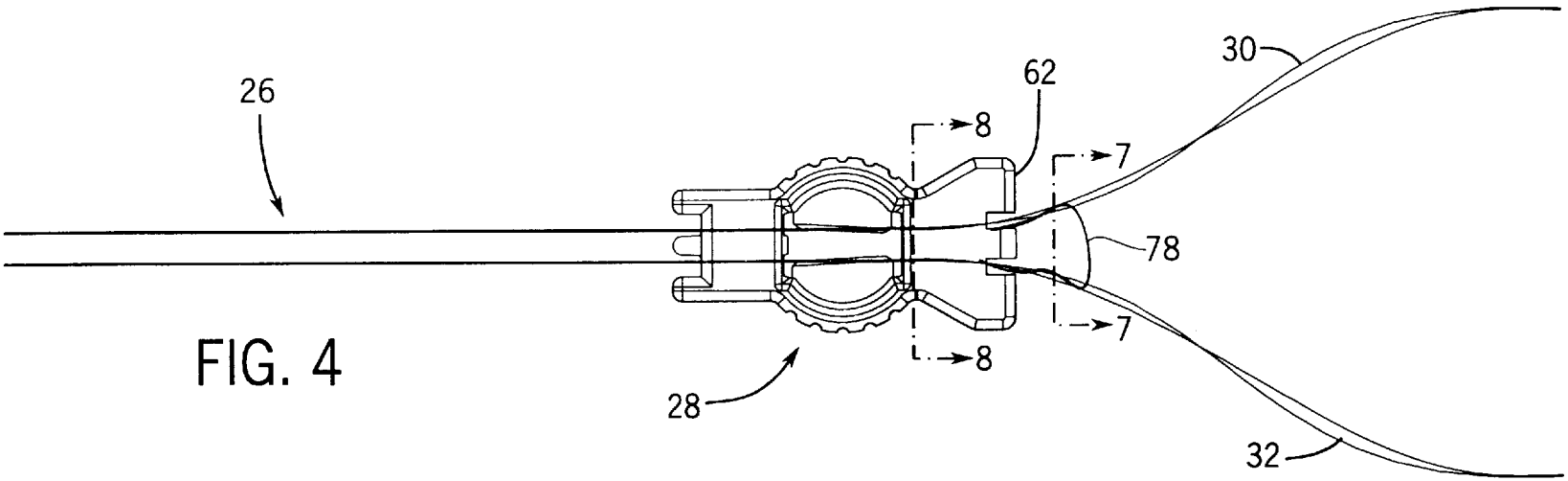
FIG. 4 is a top view illustrating the movement of the slider device along the zipper closure.

As can be seen in FIG. 4, the cleaning plow 78 projects from the first end 62 of the slider device 28. The width of the cleaning plow 78 is such that the cleaning plow 78 contacts both of the first closure profile 30 and the second closure profile 32 prior to the closure profiles being guided into an interlocking condition by the spreader 72 formed along the slider device 28.

Figure 7:
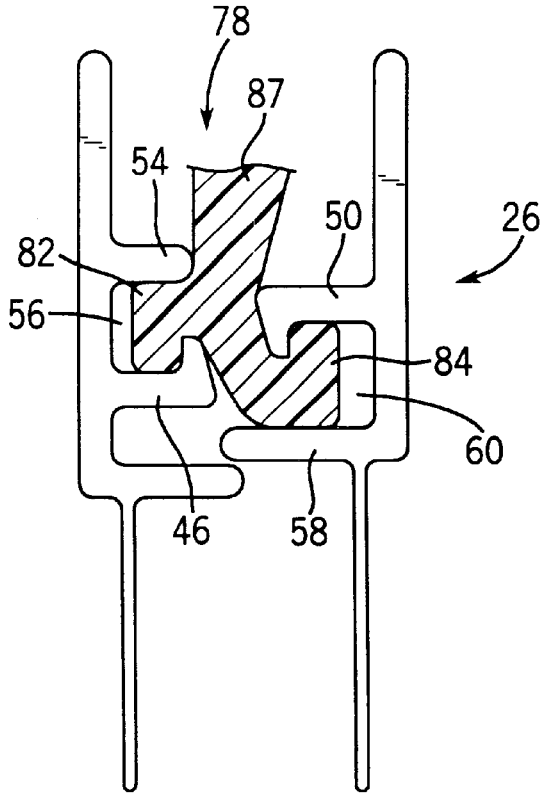
FIG. 7 is a section view taken along line 7—7 of FIG. 4 showing the cleaning plow within the zipper closure.

Referring now to FIG. 7, thereshown is a section view of the cleaning plow 78. As illustrated, the cleaning plow 78 is a solid, molded plastic structure that includes a main body 81, a first cleaning projection 82 and a second cleaning projection 84. The main body 81 is integrally formed with the slider device 28, as shown in FIG. 3. Referring back to FIG. 7, the first cleaning projection 82 extends laterally from the main body 81 and is configured to be received within the first open channel 56 formed between the first guide post 54 and the first closure post 46. Likewise, the second cleaning projection 84 extends in the opposite, lateral direction from the main body 81 and is configured to be received in the second open channel 60 formed between the second closure post 50 and the second guide post 58

As can be understood in FIG. 7, when the cleaning plow 78 is moved along the length of the zipper closure 26, the first cleaning projection 82 removes debris from the first open channel 56, while the second cleaning projection 84 removes debris from the second open channel 60. After debris has been removed, the first and second closure profiles 30, 32 are brought into engagement by the slider device 28, as illustrated in FIG. 2.

Although a specific shape for the cleaning plow 78 is shown in FIG. 7, it is contemplated by the inventor that the shape of the cleaning plow 78 could have many other configurations, as long as a first cleaning projection 82 and a second cleaning projection 84 removed the debris from the open channels 56 and 60 prior to sealing of the zipper closure 26.

As can be seen in FIG. 4, the width of the cleaning plow 78 is greater than the width of the zipper closure 26 after the first and second closure profiles 30 and 32 have been brought into engagement, as illustrated to the left of the slider device 28 in FIG. 4. Since the width of the cleaning plow 78 exceeds the width of the zipper closure 26, a portion of the first and second closure profiles 30,32 must be removed to allow the slider device to reach a fully closed position.

Figure 5:
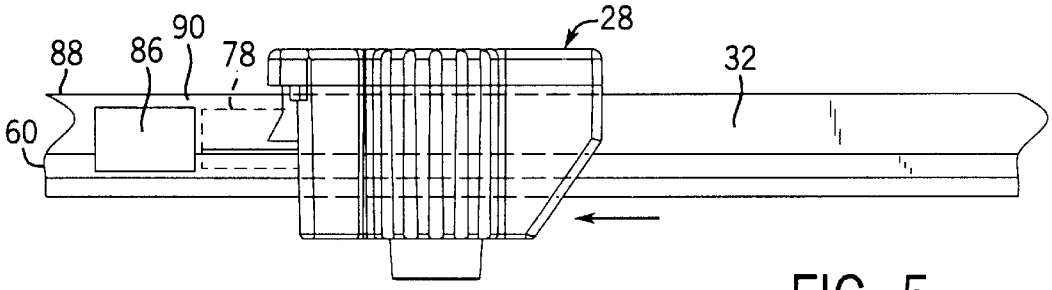
FIG. 5 is a side view of the slider device positioned along the zipper closure.

Referring now to FIG. 5, a cleaner relief 86 is formed as a removed section of the second closure profile 32. The cleaner relief 86 is positioned beneath the top edge 88 of the closure profile 32 such that a bridge section 90 exists between the cleaner relief 86 and the top edge 88 of the second closure profile 32. The lower portion of the cleaner relief 86 extends into the open channel 60 such that debris pushed along the length of the open channel 60 by the cleaning plow 78 can be pushed out of the package through the cleaner relief 86. As the slider device 78 is used to close the mouth of the package and bring the first and second closure profiles 30, 32 into engagement with each other, debris is slid along the open channels 56 and 60 until the slider device 28 reaches the position shown in FIG. 5. Further movement of the slider device 28 toward the cleaner relief 86 causes the particles of material to be pushed out of the cleaner relief 86 to the exterior of the product package. In this manner, the cleaner relief 86 provides a location for discharging the product particles that were contained within the open channel 60.

Figure 6:
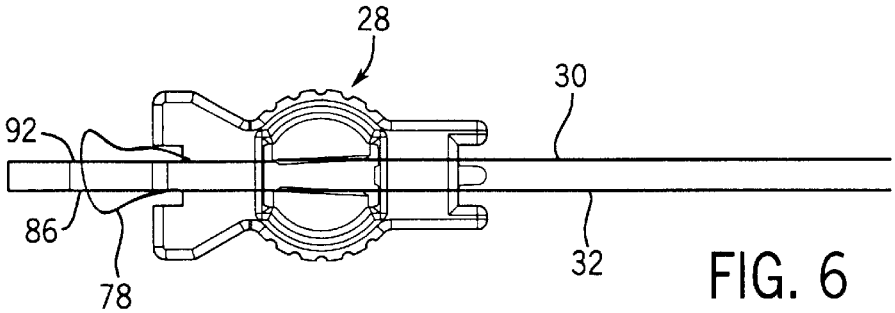
FIG. 6 is a top view of the slider device in its home, fully closed position.

Referring now to FIG. 6, a corresponding cleaner relief 92 is formed in the first closure profile 30 and is generally aligned with the cleaner relief 86 formed in the second closure profile 32. Thus, when the slider device 28 reaches its fully closed position, as illustrated in FIG. 6, the cleaning plow 78 discharges debris from the first and second open channels 56, 60 and extends through the pair of aligned cleaner reliefs 86 and 92. The movement of the cleaning plow 78 into alignment with the cleaner reliefs 86, 92 allows product to be pushed out of the pair of open channels 56 and 60 to the exterior of the package.

Having described the presently preferred embodiments, it is to be understood that the invention may be otherwise embodied within the scope of the appended claims.

What is claimed is:

1. A flexible, reclosable package comprising:

a pair of side panels joined along a first side edge and a second side edge, the panels defining a mouth providing access to a package interior;

a reclosable zipper positioned along the mouth of the package for selectively opening and closing the package mouth, the zipper including a first closure profile and a second closure profile each constructed and arranged to interlock each other to hold the mouth in a closed position; and a slider device extending between a first end and a second end, the slider device being operably mounted on the zipper, the slider device being configured to interlock the first closure profile with the second closure profile when the slider device is moved in a first direction and disengage the first closure profile from the second closure profile when the slider device is moved in a second, opposite direction;

wherein the slider device includes a cleaning plow projecting laterally from the first end of the slider device and extending along the first direction of travel of the slider device, the cleaning plow including a first cleaning projection for engaging the first closure profile and a second cleaning projection for engaging the second closure profile to remove debris from therebetween prior to the first closure profile engaging the second closure profile as the slider device is moved in the first direction; and wherein a first cleaner relief is formed in the first closure profile and a second cleaner relief is formed in the second closure profile, the first and second cleaner reliefs each being formed adjacent to the first side edge of the package, the first and second cleaner reliefs being configured to receive the cleaning plow when the slider device is moved to a closed position.

2. A flexible, reclosable package comprising:

a pair of side panels joined along a first side edge and a second side edge, the panels defining a mouth providing access to a package interior;

a reclosable zipper position along the mouth of the package for selectively opening and closing the package mouth, the zipper including a first closure profile and a second closure profile each constructed and arranged to interlock each other to hold the mouth in a closed position, the first closure profile including a first closure post and a first guide post, the second closure profile including a second closure post and a second guide post, the first guide post being retained between the second closure post and the second guide post when the zipper is in the interlocked position;

a slider device operatively mounted on the zipper, the slider device being configured to interlock the first closure profile with the second closure profile when the slider device is moved in a first direction and disengage the first closure profile from the second closure profile when the slider device is moved in a second, opposite direction;

a cleaning plow integrally formed with the slider device and projecting from the slider device, the cleaning plow including a first cleaning projection configured to be received between the first closure post and the first guide post and a second cleaning projection configured to be received between the second closure post and the second guide post such that the cleaning plow removes debris from between the first closure profile and the second closure profile prior to the first closure profile engaging the second closure profile as the slider device is moved in the first direction, wherein the first closure profile includes a cleaner relief, the cleaner relief being formed such that at least a portion of the cleaner relief extends between the first closure post and the first guide post; and wherein the second closure profile includes a second cleaner relief, the second cleaner relief being formed such that at least a portion of the second cleaner relief extends between the second closure post and the second guide post.

wherein the first cleaning projection pushes debris along the first closure profile and through the first cleaner relief and the second cleaning projection pushes debris along the second closure profile and through the second cleaner relief as the slider device is moved in the first direction to interlock the first and second closure profiles.

3. A flexible, reclosable package comprising:

a pair of side panels joined along a first side edge and a second side edge, the panels defining a mouth providing access to a package interior;

a reclosable zipper positioned along the mouth of the package for selectively opening and closing the package mouth, the zipper including a first closure profile and a second closure profile each constructed and arranged to interlock each other to hold the mouth in a closed position, wherein the first closure profile includes a first open channel and the second closure profile includes a second open channel, the first and second open channels facilitating the interlocking of the first closure profile with the second closure profile;

a slider device operably mounted on the zipper, the slider device being configured to interlock the first closure profile with the second closure profile when the slider device is moved in a first direction and disengage the first closure profile from the second closure profile when the slider device is moved in a second, opposite direction, wherein the slider device includes a cleaning plow projecting from the slider device, the cleaning plow including a first cleaning projection for engaging the first closure profile and a second cleaning projection for engaging the second closure profile to remove debris from therebetween prior to the first closure profile engaging the second closure profile as the slider device is moved in the first direction; and a first cleaner relief formed in the first closure profile and a second cleaner relief formed in the second closure profile, the first and second cleaner reliefs each being formed adjacent to the first side edge of the package, the first and second cleaner reliefs being configured to receive the cleaning plow.

4. The flexible package of claim 3 wherein at least a portion of the cleaner relief formed in the first closure profile extends into the first open channel; and wherein at least a portion of the second cleaner relief formed in the second closure profile extends into the second open channel such that debris can be pushed along the first and second open channels and through the respective first and second cleaner reliefs by the cleaning plow.

5. A reclosable zipper arrangement comprising:

a first and a second closure profile configured to releasably engage each other;

a slider device operatively mounted on the zipper, the slider device extending from a first end to a second end, the slider device being configured to interlock the first closure profile with the second closure profile when the slider device is moved in a first direction and disengage the first closure profile from the second closure profile when the slider device is moved in a second, opposite direction;

a cleaning plow projecting laterally from the first end of the slider device and extending along the first direction of travel of the slider device, the cleaning plow including a first cleaning projection for engaging the first closure profile and a second cleaning projection or engaging the second closure profile to remove debris from between the first closure profile and the second closure profile prior to the first closure profile engaging the second closure profile as the slider device is moved in the first direction; and wherein a first cleaner relief is formed in the first closure profile and a second cleaner relief is formed in the second closure profile, the first and second cleaner reliefs each being formed adjacent to the first side edge of the package, the first and second cleaner reliefs being configured to receive the cleaning plow when the slider device is moved to a closed position.

6. A reclosable zipper arrangement comprising:

a first and a second closure profile configured to releasably engage each other, the first closure profile including a first closure post and a first guide post, the second closure profile including a second closure post and a second guide post, the first guide post being retained between the second closure post and the second guide post when the zipper is in an interlocked position;

a slider device operatively mounted on the zipper, the slider device being configured to interlock the first closure profile with the second closure profile when the slider device is moved in a first direction and disengage the first closure profile from the second closure profile when the slider device is moved in a second, opposite direction; and a cleaning plow integrally formed with the slider device and projecting from the silder device, the cleaning plow including a first cleaning projection configured to be received between the first closure post and the first guide post and a second cleaning projection configured to be received between the second closure post and the second guide post, wherein the cleaning plow moves debris from between the first closure profile and the second closure profile prior to the first closure profile engaging the second closure profile as the slider device is moved in the first direction, wherein the first closure profile includes a cleaner relief; the cleaner relief being formed such that at least a portion of the cleaner relief extends between the first closure post and the first guide post; and wherein the second closure profile includes a second cleaner relief, the second cleaner relief being formed such at least a portion of the second cleaner relief extends between the second closure post and the second guide post, wherein the first cleaning projection pushes debris along the first closure profile and through the first cleaner relief and the second cleaning projection pushes debris along the second closure profile and through the second cleaner relief as the slider device is moved in the first direction to interlock the first and second closure profiles.

7. A reclosable zipper arrangement comprising:

a first and a second closure profile configured to releasably engage each other, the first closure profile including a first open channel and the second closure profile including a second open channel, the first and second open channels facilitating the interlocking of the first closure profile with the second closure profile;

a slider device operatively mounted on the zipper, the slider device being configured to interlock the first closure profile with the second closure profile when the slider device is moved in a first direction and disengage the first closure profile from the second closure profile when the slider device is moved in a second, opposite direction;

a cleaning plow projecting from the slider device, the cleaning plow including a first cleaning projection for engaging the first closure profile and a second cleaning projection for engaging the second closure profile to remove debris from between the first closure profile and the second closure profile prior to the first closure profile engaging the second closure profile as the slider device is moved in the first direction; and a first cleaner relief form in the first closure profile and a second cleaner relief formed in the second closure profile, the first and second cleaner reliefs each being formed adjacent to the first side edge of the package, the first and second cleaner reliefs being configured to receive the cleaning plow.

8. The reclosable zipper of claim 7 wherein at least a portion of the cleaner relief formed in the first closure profile extends into the first open channel; and wherein at least a portion of the second cleaner relief formed in the second closure profile extends into the second open channel such that debris can be pushed along the first and second open channels and through the respective first and second cleaner reliefs by the cleaning plow.

* * * * *